US010095133B2

(12) United States Patent
Haruyama et al.

(10) Patent No.: US 10,095,133 B2
(45) Date of Patent: Oct. 9, 2018

(54) ELECTROPHOTOGRAPHIC PHOTORECEPTOR, PROCESS CARTRIDGE, AND IMAGE FORMING APPARATUS

(71) Applicant: FUJI XEROX CO., LTD., Tokyo (JP)

(72) Inventors: Daisuke Haruyama, Kanagawa (JP); Masahiko Miyamoto, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 15/343,264

(22) Filed: Nov. 4, 2016

(65) Prior Publication Data

US 2017/0357167 A1 Dec. 14, 2017

(30) Foreign Application Priority Data

Jun. 13, 2016 (JP) ..... 2016-117402

(51) Int. Cl.
*G03G 5/043* (2006.01)
*G03G 15/00* (2006.01)

(52) U.S. Cl.
CPC ..... *G03G 5/043* (2013.01); *G03G 15/00* (2013.01)

(58) Field of Classification Search
CPC ..... G03G 5/043; G03G 15/00
See application file for complete search history.

(56) References Cited

FOREIGN PATENT DOCUMENTS

JP 2013-205479 A 10/2013

*Primary Examiner* — Thorl Chea
(74) *Attorney, Agent, or Firm* — Sughrue Mion, PLLC

(57) ABSTRACT

An electrophotographic photoreceptor includes a conductive support in which (i) a recessed portion having an opening diameter of greater than 400 μm and (ii) a recessed portion having an opening diameter of from 100 μm to 400 μm and a ratio of a depth to an opening diameter of greater than 0.12 are not present on an outer peripheral surface, wherein even in a case where a first recessed portion having an opening diameter of from 100 μm to 400 μm and a ratio of a depth to an opening diameter of 0.12 or less is present on the outer peripheral surface of the conductive support and a second recessed portion on which the first recessed portion is reflected is present on the outer peripheral surface of an outermost layer, a ratio of a depth to an opening diameter of the second recessed portion is not greater than 0.030.

12 Claims, 6 Drawing Sheets

ELECTROPHOTOGRAPHIC PHOTORECEPTOR, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2016-117402 filed Jun. 13, 2016.

BACKGROUND

1. Technical Field

The present invention relates to an electrophotographic photoreceptor, a process cartridge, and an image forming apparatus.

2. Related Art

An electrophotographic photoreceptor in which at least a photosensitive layer is disposed on a conductive support is known as an electrophotographic photoreceptor which is provided in an electrophotographic image forming apparatus.

SUMMARY

According to an aspect of the invention, there is provided an electrophotographic photoreceptor including:

a conductive support in which (i) a recessed portion having an opening diameter of greater than 400 μm and (ii) a recessed portion having an opening diameter of from 100 μm to 400 μm and a ratio of a depth to an opening diameter of greater than 0.12 are not present on an outer peripheral surface of the conductive support;

an undercoating layer that is provided on the conductive support; and a photosensitive layer that is provided on the undercoating layer, wherein even in a case where a first recessed portion having an opening diameter of from 100 μm to 400 μm and a ratio of a depth to an opening diameter of 0.12 or less is present on the outer peripheral surface of the conductive support and a second recessed portion on which the first recessed portion is reflected is present on the outer peripheral surface of an outermost layer of the electrophotographic photoreceptor, a ratio of a depth to an opening diameter of the second recessed portion is not greater than 0.030.

BRIEF DESCRIPTION OF THE DRAWINGS

Exemplary embodiments of the present invention will be described in detail based on the following figures, wherein.

DETAILED DESCRIPTION

Hereinafter, exemplary embodiments will be described. The following description and examples are merely an example of the exemplary embodiment, and are not intended to limit the scope of the invention.

In a case where the amount of each component in a composition is stated in the present specification, if there are plural types of substances which correspond to each component in the composition, unless specifically noted, the amount means a total amount of the plural types of substances present in the composition.

In the present specification, the "electrophotographic photoreceptor" is also simply referred to as a "photoreceptor".

Electrophotographic Photoreceptor

A photoreceptor according to the exemplary embodiment includes a conductive support, an undercoating layer provided on the conductive support, and a photosensitive layer provided on the undercoating layer.

In the photoreceptor according to the exemplary embodiment, (i) a recessed portion in which an opening diameter is greater than 400 μm and (ii) a recessed portion in which the opening diameter is from 100 μm to 400 μm and the ratio of a depth to the opening diameter (depth/opening diameter) is greater than 0.12 are not present on an outer peripheral surface of the conductive support.

In addition, in the photoreceptor according to the exemplary embodiment, a recessed portion (a first recessed portion) in which an opening diameter is from 100 μm to 400 μm and the ratio of the depth to the opening diameter (depth/opening diameter) is 0.12 or less is provided on the outer peripheral surface of the conductive support, and even in a case where a recessed portion (a second recessed portion) on which the first recessed portion is reflected is provided on an outer peripheral surface of an outermost layer of the photoreceptor, the ratio of depth to the opening diameter (depth/opening diameter) of the second recessed portion is not greater than 0.030.

Hereinafter, the ratio of the depth to the opening diameter (depth/opening diameter) is also referred to as an "aspect ratio".

In the exemplary embodiment, the opening diameter means a major axis of an opening, and the major axis means a maximum length among distances between two arbitrary points on a contour.

Figure 1:
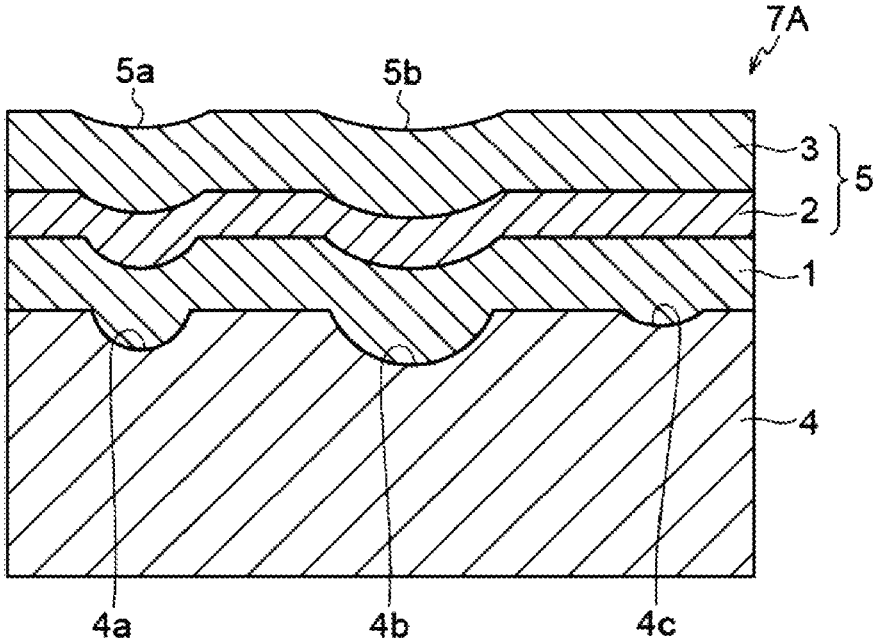
FIG. 1 is a partial sectional view schematically illustrating an example of a layer structure of an electrophotographic photoreceptor according to the exemplary embodiment.
Figure 2:
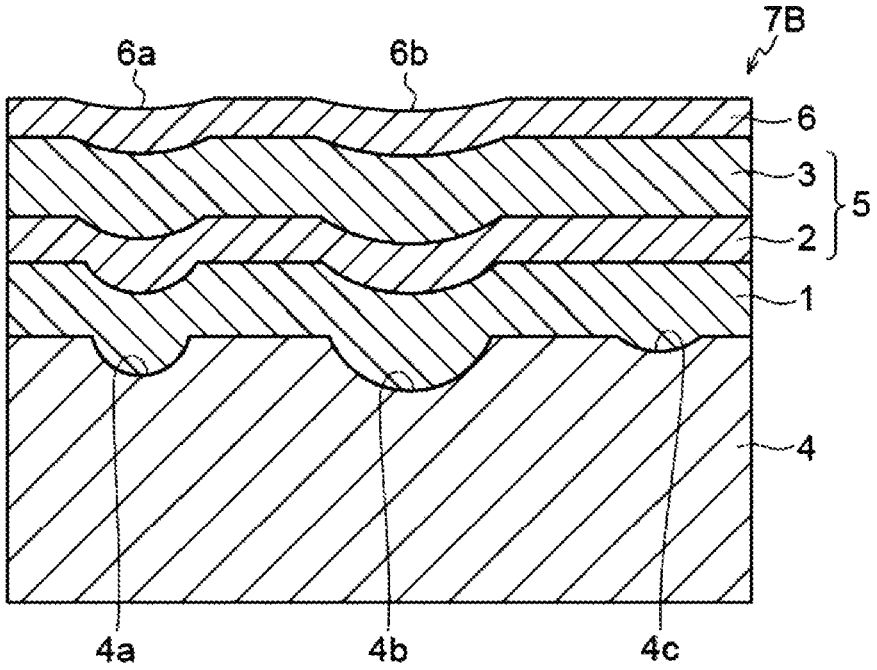
FIG. 2 is a partial sectional view schematically illustrating an example of the layer structure of the electrophotographic photoreceptor according to the exemplary embodiment.

Hereinafter, the photoreceptor according to the exemplary embodiment will be described with reference to FIG. 1 and FIG. 2. FIG. 1 and FIG. 2 are partial sectional views schematically illustrating an example of a layer structure of the photoreceptor.

A photoreceptor 7A illustrated FIG. 1 has a structure in which an undercoating layer 1, a charge generation layer 2, and a charge transport layer 3 are sequentially stacked on a conductive support 4. The charge generation layer 2 and the charge transport layer 3 constitute a photosensitive layer 5. In the photoreceptor 7A, the photosensitive layer 5 is an outermost layer.

A photoreceptor 7B illustrated in FIG. 2 has a structure in which the undercoating layer 1, the charge generation layer 2, the charge transport layer 3, and a protective layer 6 are sequentially stacked on the conductive support 4. The charge generation layer 2 and the charge transport layer 3 constitute the photosensitive layer 5. In the photoreceptor 7B, the protective layer 6 is an outermost layer.

The photosensitive layer 5 may be a function separation type photosensitive layer in which the charge generation layer 2 and the charge transport layer 3 are separated from each other, and may be a single-layer type photosensitive layer in which the charge generation layer 2 and the charge transport layer 3 are integrated with each other. In the function separation type photosensitive layer 5, the charge transport layer 3 may be an under layer, and the charge generation layer 2 may be an upper layer. An intermediate layer may be provided between the undercoating layer 1 and the photosensitive layer 5.

In the photoreceptor 7A and the photoreceptor 7B, the recessed portions 4*a*, 4*b*, and 4*c* are scattered on the outer peripheral surface of the conductive support 4. The opening diameter of all of the recessed portions 4*a*, 4*b*, and 4*c* is 400 μm or less. In addition, among the recessed portions 4*a*, 4*b*, and 4*c*, the recessed portions having an opening diameter of from 100 μm to 400 μm have an aspect ratio of 0.12 or less.

In the photoreceptor 7A, recessed portions 5*a* and 5*b* on which the recessed portions 4*a* and 4*b* which are present on the outer peripheral surface of the conductive support 4 are reflected are scattered on the photosensitive layer 5 which is the outermost layer. The aspect ratio of each of the recessed portions 5*a* and 5*b* is 0.030 or less.

In the photoreceptor 7B, recessed portions 6*a* and 6*b* on which the recessed portions 4*a* and 4*b* which are present on the outer peripheral surface of the conductive support 4 are reflected are scattered on the photosensitive layer 6 which is the outermost layer. The aspect ratio of each of the recessed portions 6*a* and 6*b* is 0.030 or less.

The photoreceptor according to the exemplary embodiment prevents a white spot from being generated in an image. The reason is presumed as follows.

An impact pressing method is known as one processing method of preparing the conductive support for the photoreceptor; however, fine recessed portions may be present on the outer peripheral surface of the conductive support which is an impact press article. In consideration that the impact pressing is a processing method of disposing the metal ingot in a circular female die, and casting the in a cylindrical male die so as to mold a hollow cylindrical member, the surface of the metal ingot becomes the outer peripheral surface of the hollow cylindrical member, and thus it is presumed that ruggedness which is present on the surface of the metal ingot becomes the ruggedness on the outer peripheral surface of the hollow cylindrical member. After that, it is presumed that when ironing is performed, the convex portion is flattened; whereas the recessed portion remains on the outer peripheral surface of the hollow cylindrical member, that is, on the outer peripheral surface of the conductive support.

Further, when the recessed portion is present on the outer peripheral surface of the conductive support, the recessed portion on which the recessed portion is reflected appears on the outer peripheral surface of the outermost layer of the photoreceptor having respective layers disposed on the conductive support, and when a high density image is formed, the white spot may be generated in the image as the portion corresponding to the recessed portion of the outer peripheral surface of the outermost layer. As the recessed portion of the outer peripheral surface of the outermost layer has a large opening diameter or a large aspect ratio, the white spot is more likely to be generated.

In contrast, regarding the photoreceptor according to the exemplary embodiment, it is presumed that the recessed portion having an excessively large opening diameter does not appear on the outer peripheral surface of the outermost layer when the recessed portion having the opening diameter which is larger than 400 μm is not present on the outer peripheral surface of the conductive support, in other words, when the size of the opening diameter is limited to be within a range of 400 μm or less even in a case where the recessed portion is present on the outer peripheral surface of the conductive support.

In addition, regarding the photoreceptor according to the exemplary embodiment, it is presumed that the recessed portion having an excessively large aspect ratio does not appear on the outer peripheral surface of the outermost layer when the recessed portion having the opening diameter which is from 100 μm to 400 μm, and the aspect ratio which is greater than 0.12 is not present on the outer peripheral surface of the conductive support, in other words, even in a case where the recessed portion having the opening diameter which is from 100 μm to 400 μm is present on the outer peripheral surface of the conductive support, the aspect ratio is regulated to be in a range of 0.12 or less.

For this reason, regarding the photoreceptor according to the exemplary embodiment, it is presumed that the white spot is unlikely to be generated in the image.

In the exemplary embodiment, the opening diameter of the recessed portion which is present on the outer peripheral surface of the conductive support is regulated to be within a range of 400 μm or less, and the aspect ratio of the recessed portion having the opening diameter which is from 100 μm to 400 μm is regulated to be in a range of 0.12 or less. When the aspect ratio is large even in a case where the opening diameter is 400 μm or less, it is presumed that the recessed portion which easily causes the white spot is likely to be generated on the outer peripheral surface of the outermost layer, and thus the aspect ratio is set to be in a range of 0.12 or less. From the aspect that the white spot is prevented from being generated, it is preferable as the aspect ratio is small, for example, the aspect ratio is more preferably 0.11 or less, and is still more preferably 0.10 or less.

In the exemplary embodiment, from the aspect that the white spot is prevented from being generated, a first recessed portion having the opening diameter which is from 100 μm to 400 μm, and the aspect ratio which is 0.12 or less is present on the outer peripheral surface of the conductive support, and even in a case where a second recessed portion on which the first recessed portion is reflected is present on the outer peripheral surface of the outermost layer, the aspect ratio of the second recessed portion is regulated to be within a range of 0.030 or less. It is preferable as the aspect ratio of the second recessed portion is small, for example, the aspect ratio thereof is more preferably 0.025 or less, and is still more preferably 0.020 or less. Further, the opening diameter of the second recessed portion is 540 μm or less, is more preferably 535 μm or less, and is still more preferably 530 μm or less.

The size of the recessed portion which is present on the outer peripheral surface of the conductive support may be controlled by the processing conditions at the time of molding through impact pressing. For example, by adjusting an amount of a lubricant applied to the surface of the metal ingot, or controlling a crystal particle diameter in the vicinity of the metal ingot it is possible to prevent the recessed portion from being greater than the above-described range.

Father, it is preferable to select the conductive support in which the size of the recessed portion which is present on the outer peripheral surface of the conductive support is within the above-described range by inspecting the surface of the conductive support after molding. It is possible to prepare the photoreceptor having the aspect ratio of the second recessed portion which is regulated to be within the above-described range by disposing the undercoating layer and the photosensitive layer on the selected conductive support. As the undercoating layer is thickened, the aspect ratio of the second recessed portion may be regulated to be low; however, it is preferable that the undercoating layer is not excessively thickened in order to prevent ghost (a phenomenon that previous image appears on the next image) from being generated.

Hereinafter, the respective photoreceptors will be described in detail. Reference numerals will be omitted.

Conductive Support

In the conductive support according to the exemplary embodiment, the "conductivity" means the volume resistivity which is less than $10^{13}$ Ωcm.

The conductive support is a cylindrical member, or may be, for example, a hollow member or a non-hollow member. In order to realize light reduction of the photoreceptor, it is preferable that the conductive support is the hollow member. In a case where the conductive support is the hollow member, the thickness is preferably 0.9 mm or less, and is more preferably 0.8 mm or less in order to realize light reduction of the photoreceptor, and is preferably 0.2 mm or more, and the thickness is more preferably 0.4 mm or more in order to secure the strength of the conductive support.

Examples of the metal constituting the conductive support include pure metal such as aluminum, iron, and copper; and an alloy such as a stainless steel and an aluminum alloy. The examples of the metal constituting the conductive support are preferably metal containing aluminum, and are more preferably pure aluminum or an aluminum alloy in terms of the lightness and excellent workability. The aluminum alloy are not particularly limited as long as the alloy has aluminum as a major component, and examples thereof include an aluminum alloy containing Si, Fe, Cu, Mn, Mg, Cr, Zn, Ti, and the like in addition to aluminum. Here, the "major component" means an element having the highest content ratio (by weight) among the elements contained in the alloy. As the metal constituting the conductive support, in terms of the workability, the metal having the aluminum content (weight ratio) is preferably 90.0% or more, the metal having the aluminum content is more preferably 95.0% or more, the metal having the aluminum content is still more preferably 99.0% or more.

The conductive support is prepared by a well-known molding process such as reducing, drawing, impact pressing, ironing, and cutting. The conductive support is preferably prepared through the impact pressing in order to realize thickness reduction and high hardness, and the conductive support is more preferably prepared through the impact pressing and the ironing in succession. That is, the conductive support is preferably an impact press article or an impact press article which is subjected to ironing.

The impact pressing is a processing method of disposing the metal ingot in a circular female die, and casting the in a cylindrical male die so as to mold a hollow cylindrical member along the male die. After molding the hollow cylindrical member through the impact pressing, and an inner diameter, an outer diameter, a cylindrical degree, and circularity are adjusted by performing one or plural time of the ironing so as to obtain the conductive support. After ironing, an end face treatment may be further performed by cutting off both ends of the cylindrical tube. Hereinafter, the exemplary embodiment of impact pressing and ironing will be described.

Impact Pressing

Figure 3A:
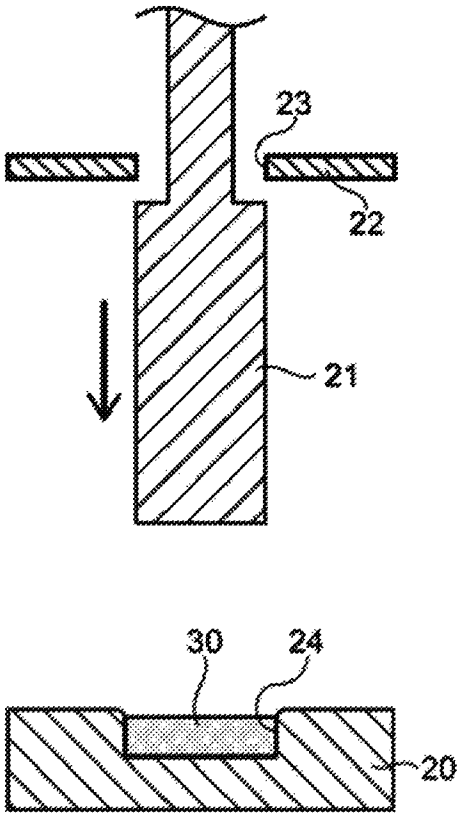
FIG. 3A to FIG. 3C are schematic diagrams illustrating an example of impact pressing for forming a conductive support.
Figure 3B:
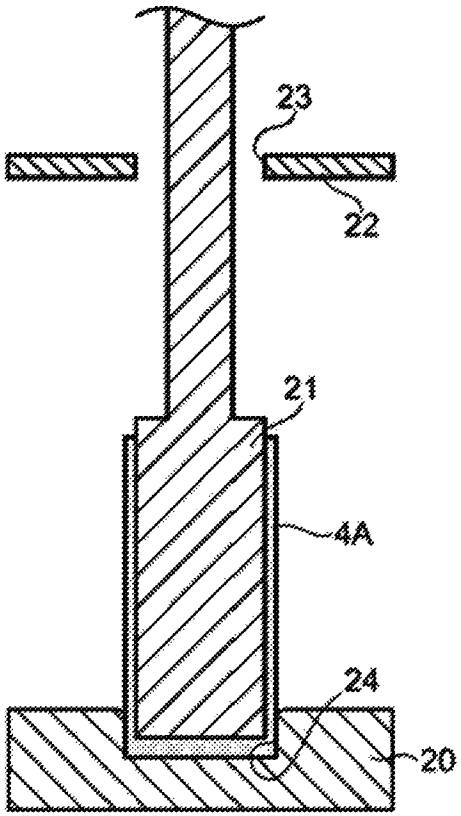
Figure 3C:
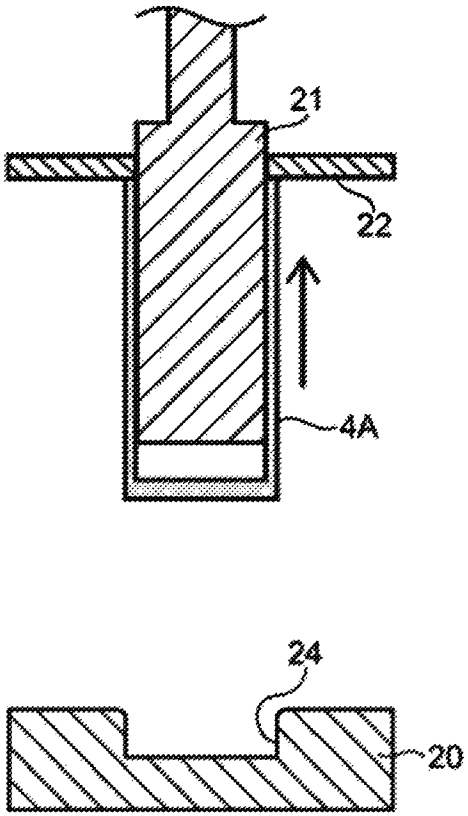

FIGS. 3A to 3C illustrate an example of a step of molding the hollow cylindrical member by performing impact pressing on a metal ingot. As illustrated in FIG. 3A, a disk-shaped metal ingot 30 in which a lubricant is applied to the surface thereof is disposed in a circular hole 24 which is provided in a die (a female die) 20. Then, as illustrated in FIG. 3B, a hollow cylindrical member 4A is molded by pressing the metal ingot 30 by using a cylindrical punch (male) 21. Subsequently, as illustrated in FIG. 3C, the punch 21 is taken out from the hollow cylindrical member 4A by picking up the punch 21 via a center hole 23 of a stripper 22.

In the impact pressing, the metal ingot 30 which is pressed by the punch 21 molds the hollow cylindrical member 4A by extending into the cylindrical shape so as to cover around the punch 21, and thus the surface of the metal ingot 30 (particularly, a bottom surface at the time of being placed in the circular hole 24) becomes an outer peripheral surface of the hollow cylindrical member 4A. For this reason, the ruggedness of the surface of the metal ingot 30 reflects on the ruggedness of the outer peripheral surface of the hollow cylindrical member 4A.

It is preferable that the lubricant is applied to the surface of the metal ingot 30. With the lubricant, it is presumed that the friction between the punch 21 and the metal ingot 30 is decreased, and the metal ingot 30 more uniformly extends so as to cover around the punch 21, and the ruggedness of the outer peripheral surface of the hollow cylindrical member 4A is reduced. Examples of the lubricant applied to the surface of the metal ingot 30 include fatty acid metal salt (for example, zinc stearate, aluminum stearate, sodium stearate, magnesium stearate, zinc laurate, and potassium laurate); long-chain fatty acid and polyol ester (for example, fatty acid having 5 to 22 carbon atoms, and esters of polyol such as neopentyl glycol, trimethylol propane, and pentaerythritol); and a liquid hydrocarbon polymer (for example, a copolymer of polybutene, polyisobutylene, isobutene, and normal butene; a copolymer of isobutene and isopropylene, a copolymer of isobutene and butadiene, a copolymer of normal butene and styrene, and a copolymer of normal butene and isopropylene). As the lubricant applied to the surface of the metal ingot 30, the fatty acid metal salt is preferably used in order to decrease the ruggedness of the outer peripheral surface of the hollow cylindrical member 4A.

A material, shape, size, and the like of the metal ingot 30 may be selected in accordance with a material, shape, size, and the like of a conductive support to be prepared. The metal ingot 30 is preferably formed of pure aluminum or an aluminum alloy in terms of the excellent workability. The aluminum content (weight ratio) of the metal ingot 30 is preferably 90.0% or more, is more preferably 95.0% or more, and is still more preferably 99.0% or more in terms of the excellent workability.

The metal ingot 30 may be subjected to a surface modification treatment in order to control the crystal particle diameter in the vicinity of the surface. Examples of the surface modification treatment include hardening, a nitriding treatment, and burnishing.

The thickness of the hollow cylindrical member 4A is selected in accordance with the inner diameter, the outer diameter, and the thickness of the conductive support to be prepared, and the number of times of ironing which is performed thereafter.

The hollow cylindrical member 4A may be subjected to annealing before performing the ironing.

Ironing

Figure 4B:
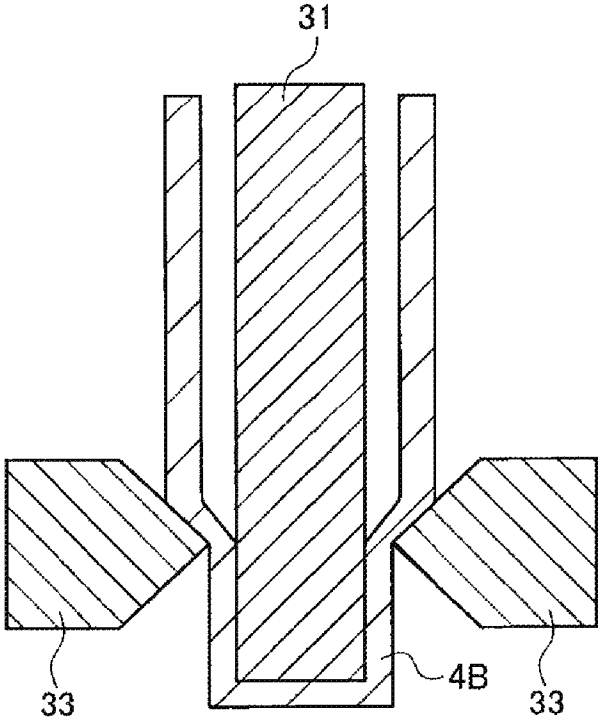
FIG. 4A and FIG. 4B are schematic diagrams illustrating an example of ironing for forming a conductive support.
Figure 4A:
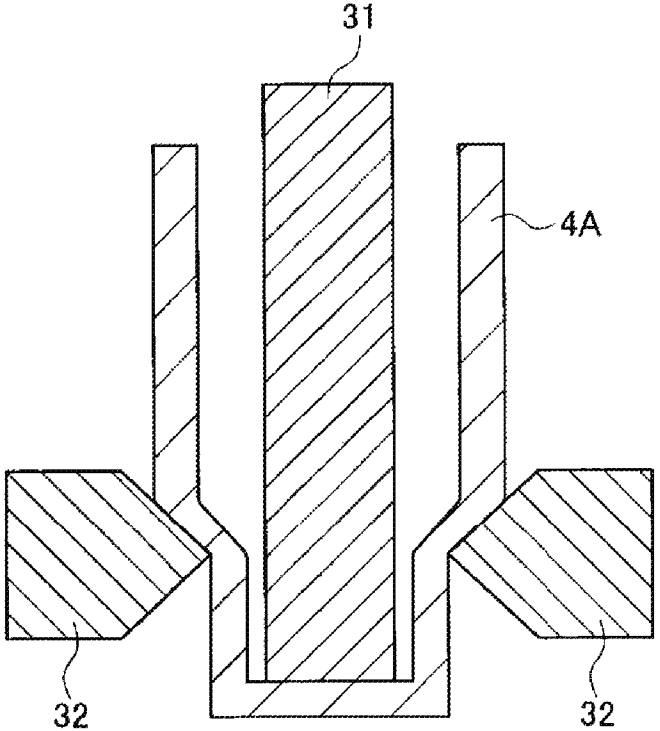

FIG. 4A and FIG. 4B illustrate an example of a step of performing the ironing on the hollow cylindrical member. FIG. 4A and FIG. 4B illustrate an example of performing the ironing as illustrated in FIG. 4B after performing the drawing as illustrated in FIG. 4A.

As illustrated in FIG. 4A, the diameter of the hollow cylindrical member 4A is reduced by inserting cylindrical punch 31 into the inside of the hollow cylindrical member 4A, and pressing the punch 31 for each hollow cylindrical member 4A into a die 32 having a diameter which is smaller than that of the hollow cylindrical member 4A. Then, as illustrated in FIG. 4B, the hollow cylindrical member 4B having a thickness which is smaller than that of the hollow cylindrical member 4A by pressing the punch 31 for each hollow cylindrical member 4A into a die 33 having a diameter which is smaller than that of the die 32. Note that, the ironing may be performed without drawing, or the ironing may be performed by being divided into plural stages. The convex portion which is present on the outer peripheral surface of the hollow cylindrical member 4A is flattened by performing the ironing on the hollow cylindrical member 4A.

The surface of the conductive support may be subjected to a well-known surface treatment such as an anodic oxidation treatment, an oxidation treatment, and a boehmite treatment.

Undercoating Layer

The average thickness of the undercoating layer is from 15 μm to 50 μm, for example. The average thickness of the undercoating layer is preferably 20 μm or more, is more preferably 25 μm or more, and is still more preferably 30 μm or more in order to prevent the second recessed portion from appearing on the outer peripheral surface of the photoreceptor. It is considered that the second recessed portion is unlikely to appear on the outer peripheral surface of the photoreceptor as the thickness of the undercoating layer is large; however, when the thickness of the undercoating layer is excessively large, ghost (a phenomenon that previous image appears on the next image) may be generated. The average thickness of the undercoating layer is preferably 40 μm or less, and is more preferably 35 μm or less in order to prevent the ghost from being generated.

The average thickness of the undercoating layer is an average value obtained by measuring a film thickness of 40 parts in total of ten equal parts in the axial direction and four equal parts (divided by 900) in a circumferential direction by using an eddy current film thickness meter.

The undercoat layer is a layer including, for example, an inorganic particle and a binder resin.

Examples of the inorganic particle include inorganic particles having powder resistance (volume resistivity) in a range of from $10^2$ Ωcm to $10^{11}$ Ωcm. Among them, as the inorganic particle having the resistance value, metal oxide particles such as tin oxide particles, titanium oxide particles, zinc oxide particles, and zirconium oxide particles may be used, and particularly, the zinc oxide particles are preferably used.

A specific surface area by a BET method of the inorganic particle may be, for example, 10 $m^2/g$ or more.

The volume average particle diameter of the inorganic particle may be, for example, from 50 nm to 2,000 nm (preferably from 60 nm to 1,000 nm).

The content of the inorganic particle is, for example, is preferably from 10% by weight to 80% by weight, and is further preferably from 40% by weight to 80% by weight, with respect to the binder resin.

The inorganic particle may be subjected to the surface treatment. Two or more inorganic particles which are subjected to the surface treatment in a different way, or which have different particle diameters may be used in combination.

Examples of a surface treatment agent include a silane coupling agent, a titanate coupling agent, an aluminum coupling agent, and a surfactant. Particularly, the silane coupling agent is preferably used, and a silane coupling agent having an amino group is further preferably used.

Examples of the silane coupling agent having an amino group include 3-aminopropyl triethoxy silane, N-2-(aminoethyl)-3-aminopropyl trimethoxy silane, N-2-(aminoethyl)-3-aminopropyl methyl dimethoxy silane, and N,N-bis(2-hydroxy ethyl)-3-aminopropyl triethoxy silane; however, the silane coupling agent is not limited to these examples.

Two or more types of the silane coupling agents may be used in combination. For example, the silane coupling agent having an amino group and other silane coupling agents may be used in combination. Examples of other silane coupling agents include vinyl trimethoxysilane, 3-methacryloxypropyl-tris(2-methoxyethoxy) silane, 2-(3,4-epoxycyclohexyl) ethyl trimethoxy silane, 3-glycidoxypropyl trimethoxy silane, vinyl triacetoxy silane, 3-mercaptopropyl trimethoxy silane, 3-aminopropyl triethoxy silane, N-2-(aminoethyl)-3-aminopropyl trimethoxy silane, N-2-(aminoethyl)-3-aminopropyl methyl dimethoxy silane, N,N-bis(2-hydroxyethyl)-3-aminopropyl triethoxy silane, 3-chloropropyl trimethoxy silane; however, other silane coupling agents are not limited to these examples.

The method of surface treatment by using the surface treatment agent is not limited as long as it is a well-known method, and a drying method or a wet method may be used.

The amount of the surface treatment agent is, for example, preferably from 0.5% by weight to 10% by weight with respect to the inorganic particle.

The undercoat layer of the exemplary embodiment may include an inorganic particle and an electron-accepting compound (acceptor compound) from the viewpoint that long-term stability of electrical characteristics and the carrier blocking properties are improved.

Examples of the electron-accepting compound include an electron transporting substance, for example, a quinone compound such as chloranil and bromanil; a tetracyanoquinodimethane compound; a fluorenone compound such as 2,4,7-trinitrofluorenone, 2,4,5,7-tetranitro-9-fluorenone; an oxadiazole compound such as 2-(4-biphenyl)-5-(4-t-butyl phenyl)-1,3,4-oxadiazole, 2,5-bis(4-naphthyl)-1,3,4-oxadiazole, 2,5-bis(4-diethyl amino-phenyl)1,3,4-oxadiazole; a xanthone compound; a thiophene compound; and a diphenoquinone compound such as 3,3',5,5' tetra-t-butyldiphenoquinone. Particularly, as the electron-accepting compound, a compound having an anthraquinone structure is preferably used. As the compound having an anthraquinone structure, for example, a hydroxyanthraquinone compound, an amino anthraquinone compound, and an amino hydroxy anthraquinone compound are preferably used, and specifically, anthraquinone, alizarin, quinizarin, anthrarufin, and purpurin are preferably used.

The electron-accepting compound may be dispersed in the undercoat layer together with the inorganic particle, or may be attached on the surface of the inorganic particle.

Examples of the method of attaching the electron-accepting compound on the surface of the inorganic particle include a drying method and a wet method.

The drying method is a method of attaching the electron-accepting compound to the surface of the inorganic particle, for example, the electron-accepting compound or the electron-accepting compound which is dissolved in the organic solvent is added dropwise, and is sprayed with dry air or nitrogen gas while stirring the inorganic particle by using a large mixer having a shear force. The electron-accepting compound may be added dropwise or sprayed at a temperature below the boiling point of the solvent. After the electron-accepting compound is added dropwise or sprayed, sintering may be performed at a temperature of 100° C. or more. The sintering is not particularly limited as long as a temperature and time for obtaining the electrophotographic properties are provided.

The wet method is a method of attaching the electron-accepting compound to the surface of the inorganic particle by removing the solvent after the electron-accepting compound is added and stirred or dispersed while dispersing the inorganic particles in the solvent through a stirrer, ultrasound, a sand mill, an attritor, a ball mill, and the like. As a method of removing a solvent, for example, the solvent is distilled off by filtration or distillation. After removing the solvent, sintering may be performed at a temperature of 100° C. or more. The sintering is not particularly limited as long as a temperature and time for obtaining the electrophotographic properties are provided. In the wet method, the water content of the inorganic particle may be removed before adding the electron-accepting compound, and examples thereof includes a method of removing the water content of the inorganic particle while stirring and heating in the solvent, and a method of removing the water content of the inorganic particle by forming an azeotrope with the solvent.

Attaching the electron-accepting compound may be performed before or after performing the surface treatment on the inorganic particle by using a surface treatment agent, and the attaching of the electron-accepting compound and the surface treatment by using a surface treatment agent may be concurrently performed.

The content of the electron-accepting compound may be from 0.01% by weight to 20% by weight, and is preferably from 0.01% by weight to 10% by weight with respect to the inorganic particle.

Examples of the binder resin used for the undercoat layer include a well-known polymer compound such as an acetal resin (such as polyvinyl butyral), a polyvinyl alcohol resin, a polyvinyl acetal resin, a casein resin, a polyamide resin, a cellulose resin, gelatin, a polyurethane resin, a polyester resin, an unsaturated polyester resin, a methacrylic resin, an acrylic resin, a polyvinyl chloride resin, a polyvinyl acetate resin, a vinyl chloride-vinyl acetate-maleic anhydride resin, a silicone resin, a silicone-alkyd resin, a urea resin, a phenol resin, a phenol-formaldehyde resin, a melamine resin, an urethane resin, an alkyd resin, and an epoxy resin; a zirconium chelate compound; a titanium chelate compound; an aluminum chelate compound; a titanium alkoxide compound; an organic titanium compound; and a well-known material such as an a silane coupling agent.

Examples of the binder resin used for the undercoat layer include a charge transport resin having a charge transport group, and a conductive resin (for example, polyaniline).

Among them, as the binder resin used for the undercoat layer, an insoluble resin in the coating solvent for the upper layer is preferably used. Particularly, examples thereof include a thermosetting resin such as a urea resin, a phenol resin, a phenol-formaldehyde resin, a melamine resin, a urethane resin, an unsaturated polyester resin, an alkyd resin, and an epoxy resin; and a resin obtained by reaction of at least one resin selected from the group consisting of a polyamide resin, a polyester resin, a polyether resin, a methacrylic resin, an acrylic resin, a polyvinyl alcohol resin, and a polyvinyl acetal resin, and a curing agent.

In a case where two or more binder resins are used in combination, the mixing ratio thereof is set if necessary.

The undercoat layer may contain various types of additives so as to improve electrical properties, environmental stability, and image quality.

Examples of the additive include well-known materials, for example, an electron transporting pigment such as a polycyclic condensed pigment and an azo pigment, a zirconium chelate compound, a titanium chelate compound, an aluminum chelate compound, a titanium alkoxide compound, an organic titanium compound, and a silane coupling agent. The silane coupling agent is used for the surface treatment of the inorganic particle as described above, and may be also added to the undercoat layer as an additive.

Examples of the silane coupling agent as an additive include vinyl trimethoxy silane, 3-methacryloxy propyl-tris (2-methoxyethoxy)silane, 2-(3,4-epoxycyclohexyl)ethyl trimethoxy silane, 3-glycidoxypropyl trimethoxy silane, vinyl triacetoxy silane, 3-mercaptopropyl trimethoxy silane, 3-aminopropyl triethoxy silane, N-2-(aminoethyl)-3-aminopropyl trimethoxy silane, N-2-(aminoethyl)-3-aminopropyl methyl methoxy silane, N,N-bis(2-hydroxyethyl)-3-aminopropyl triethoxy silane, and 3-chloro-propyl trimethoxy silane.

Examples of the zirconium chelate compound include zirconium butoxide, zirconium ethyl acetoacetate, zirconium triethanolamine, acetylacetonate zirconium butoxide, ethyl acetoacetate zirconium butoxide, zirconium acetate, zirconium oxalate, zirconium lactate, zirconium phosphonate, zirconium octanoate, zirconium naphthenate, zirconium laurate, zirconium stearate, zirconium isostearate, methacrylate zirconium butoxide, stearate zirconium butoxide, and isostearate zirconium butoxide.

Examples of the titanium chelate compound include tetraisopropyl titanate, tetra-n-butyl titanate, butyl titanate dimer, tetra(2-ethylhexyl) titanate, titanium acetylacetonate, poly titanium acetylacetonate, titanium octylene glycolate, titanium lactate ammonium salt, titanium lactate, titanium lactate ethyl ester, titanium triethanolaminate, and polyhydroxy titanium stearate.

Examples of the aluminum chelate compound include aluminum isopropylate, monobutoxy aluminum diisopropylate, aluminum butyrate, diethyl acetoacetate aluminum diisopropylate, aluminum tris (ethyl acetoacetate).

The above-described additives may be used alone or may be used as a mixture of plural compounds or polycondensate.

The Vickers' hardness of the undercoat layer may be 35 or more.

In order to prevent the occurrence of moire images, the surface roughness (ten-point average roughness) of the undercoat layer may be adjusted to ½ from 1/(4n) (n is the refractive index of the upper layer) of the using exposure laser wavelength λ.

The resin particle or the like may be added into the undercoat layer so as to adjust the surface roughness. Examples of the resin particle include a silicone resin particle, and a crosslinked polymethyl methacrylate resin particle. The surface of the undercoat layer may be polished so as to adjust the surface roughness. Examples of a polishing method include a buffing method, a sandblasting method, a wet honing method, and a grinding method.

The forming of the undercoat layer is not particularly limited, and a well-known forming method is used. For example, the method is performed in such a manner that a coated film coated with the coating liquid for forming an undercoat layer to which the above-described components are added as a solvent is formed, dried, and then heated if necessary.

Examples of the solvent for preparing the coating liquid for forming an undercoat layer include a well-known organic solvent such as an alcohol solvent, an aromatic hydrocarbon solvent, a halogenated hydrocarbon solvent, a ketone solvent, a ketone alcohol solvent, an ether solvent, and an ester solvent.

Specific examples of the solvent include general organic solvents such as methanol, ethanol, n-propanol, iso-propanol, n-butanol, benzyl alcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, chlorobenzene, and toluene.

A method of dispersing inorganic particles at the time of preparing the coating liquid for forming an undercoat layer includes a well-known method by using a roll mill, a ball mill, a vibrating ball mill, an attritor, a sand mill, a colloid mill, and a paint shaker.

Examples of the method of coating the conductive support with the coating liquid for forming an undercoat layer include a general method such as a blade coating method, a wire-bar coating method, a spray coating method, a dipping coating method, a bead coating method, an air knife coating method, and a curtain coating method.

Intermediate Layer

Although not shown in the drawings, an intermediate layer may be further provided between the undercoat layer and the photosensitive layer.

The intermediate layer is a layer including a resin. Examples of the resin used for the intermediate layer include a polymer compound such as an acetal resin (such as polyvinyl butyral), a polyvinyl alcohol resin, a polyvinyl acetal resin, a casein resin, a polyamide resin, a cellulose resin, gelatin, a polyurethane resin, a polyester resin, a methacrylic resin, an acrylic resin, a polyvinyl chloride resin, a polyvinyl acetate resin, a vinyl chloride vinyl acetate-maleic anhydride resin, a silicone resin, a silicone-alkyd resin, a phenol-formaldehyde resin, and a melamine resin.

The intermediate layer may be a layer including an organometallic compound. Examples of the organometallic compound used for the intermediate layer include an organometallic compound containing a metal atom such as zirconium, titanium, aluminum, manganese, and silicon.

The compounds used for the intermediate layer may be used alone, or may be used as a mixture of plural compounds or a polycondensate.

Among them, the intermediate layer is preferably a layer including an organometallic compound containing a zirconium atom or a silicon atom.

The forming of the intermediate layer is not particularly limited, and a well-known forming method is used. For example, the method is performed in such a manner that a coated film coated with the coating liquid for forming an intermediate layer to which the above-described components are added as a solvent is formed, dried, and then heated if necessary.

Examples of a coating method for forming an intermediate layer include a general method such as a dipping coating method, an extrusion coating method, a wire-bar coating method, a spray coating method, a blade coating method, a knife coating method, and a curtain coating method.

The thickness of intermediate layer is preferably set in a range of from 0.1 μm to 3 μm, for example. Note that, the intermediate layer may be used as an undercoat layer.

Charge Generation Layer

The charge generation layer includes, for example, a charge generation material and a binder resin. In addition, the charge generation layer may be a deposited layer of the charge generation material. The deposited layer of the charge generation material is preferably used in a case where a non-coherent light source such as a light-emitting diode (LED), organic electro-luminescence (EL) image array.

Examples of the charge generation material include an azo pigment such as bisazo and trisazo; a condensed aromatic pigment such as dibromoanthanthrone; a perylene pigment; a pyrrolopyrrole pigment; phthalocyanine pigment; zinc oxide; and trigonal selenium.

Among them, in order to correspond to the laser exposure in the near infrared region, a metal phthalocyanine pigment, or a non-metal phthalocyanine pigment are preferably used as the charge generation material. Specific examples thereof include hydroxy gallium phthalocyanine; chloro gallium phthalocyanine; dichlorotin phthalocyanine; and titanyl phthalocyanine.

On the other hand, in order to correspond to the laser exposure in the near ultraviolet region, a condensed aromatic pigment such as dibromoanthanthrone; a thioindigo pigment; a porphyrazine compound; zinc oxide; trigonal selenium; and a bisazo pigment are preferably used as the charge generation material.

In a case of using the non-coherent light source such as LED, and the organic EL image array which have the central wavelength of the emitted light in the range of from 450 nm to 780 nm, the above-described charge generation material may be used; however, in terms of the resolution, when the photosensitive layer having a thickness of 20 μm or less, the electric field strength is enhanced in the photosensitive layer, and due to reduction of charging by the charge injection from the conductive support, an image defect which is so-called "black dot" is likely to occur. This phenomine is remarkable when the charge generation material which is a p-type semiconductor such as trigonal selenium and a phthalocyanine pigment, and easily causes a dark current is used.

In contrast, in a case of using an n-type semiconductor such as a condensed aromatic pigment, a perylene pigment, and an azo pigment as the charge generation material, the dark current is unlikely to occur and the image defect which is the so-called dark dot may be prevented even with thin film.

The determination of the n-type is performed by polarity of flowing photocurrent with a time-of-flight method which is generally used, and a material which causes electrons to easily flow as carriers as compared with a hole is set as an n-type.

The binder resin used for the charge generation layer may be selected from the insulating resins in a wide range, or may be selected from organic photoconductive polymers such as poly-N-vinylcarbazole, polyvinyl anthracene, polyvinyl pyrene, and polysilanes.

Examples of the binder resin include a polyvinyl butyral resin, a polyarylate resin (a polycondensate of bisphenol and an aromatic dicarboxylic acid), a polycarbonate resin, a polyester resin, a phenoxy resin, a vinyl chloride-vinyl acetate copolymer, a polyamide resin, an acrylic resin, a polyacrylamide resin, a polyvinyl pyridine resin, a cellulose resin, an urethane resin, an epoxy resin, casein, a polyvinyl alcohol resin, and a polyvinyl pyrrolidone resin. Here "insulation properties" mean a case where the volume resistivity is $10^{13}$ Ωcm or more. These binder resins may be used alone or two or more types thereof may be used in combination.

The mixing ratio of the charge generation material to the binder resin is preferably in a range of from 10:1 to 1:10 by the weight ratio.

The charge generation layer may include other well-known additives.

The charge generation layer is not particularly limited, and a well-known forming method is used. For example, the method is performed in such a manner that a coated film coated with the coating liquid for forming a charge generation layer to which the above-described components are added as a solvent is coated, dried, and then heated if necessary. The forming of the charge generation layer may be performed by vaporizing the charge generation material. The forming of the charge generation layer performed by vaporizing the charge generation material is particularly preferable in a case where a condensed aromatic pigment and a perylene pigment are used as the charge generation material.

Examples of the solvent for preparing coating liquid for forming the charge generation layer include methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene, and toluene. These solvents may be used alone or two or more type thereof are used in combination Examples of a method of dispersing the particles (for example, charge generation material) in the coating liquid forming a charge generation layer include a method by using a media dispersing machine such as a ball mill, a vibrating ball mill, an attritor, a sand mill, and a horizontal sand mill, and a media-less disperser such as a stirrer, an ultrasonic disperser, a roll mill, and a high pressure homogenizer. Examples of the high-pressure homogenizer include a collision-type homogenizer in which a dispersion is dispersed by liquid-liquid collision, and liquid-wall collision under high pressure, and a passing-through-type homogenizer in which a dispersion is dispersed by passing the dispersion through thin flow paths under high pressure. At the time of this dispersion, the average particle diameter of the charge generation material in the coating liquid forming a charge generation layer is 0.5 μm or less, is preferably 0.3 μm or less, and further preferably 0.15 μm or less.

Examples of a method of coating the undercoat layer (or on the intermediate layer) with the coating liquid forming a charge generation layer include a general method such as a blade coating method, a wire-bar coating method, a spray coating method, a dipping coating method, a bead coating method, an air knife coating method, and a curtain coating method.

The thickness of the charge generation layer is preferably set to be in a range of from 0.1 μm to 5.0 μm, and is further preferably set to be in a range of from 0.2 μm to 2.0 μm, for example.

Charge Transport Layer

The charge transport layer is, for example, a layer including a charge transport material and a binder resin. The charge transport layer may be a layer including a polymer charge transport material.

Examples of the charge transport material include an electron transporting compound such as a quinone compound such as p-benzoquinone, chloranil, bromanil, and anthraquinone; a tetracyanoquinodimethane compound; a fluorenone compound such as 2,4,7-trinitrofluorenone; a xanthone compound; a benzophenone compound; and a cyanovinyl compound; an ethylene compound. Examples of the charge transport material include a hole-transporting compound such as a triarylamine compound, a benzidine compound, an arylalkane compound, an aryl substituted ethylene compound, a stilbene compound, an anthracene compound, and a hydrazine compound. These charge transport materials may be used alone or two or more types thereof may be used, but are not limited thereto.

As the charge transport material, in terms of charge mobility, a triarylamine derivative expressed by the following formula (a-1) and a benzidine derivative expressed by the following formula (a-2) are preferably used.

(a-1)

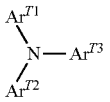

In the formula (a-1), $Ar^{T1}$, $Ar^{T2}$, and $Ar^{T3}$ each independently represent a substituted or unsubstituted aryl group, $—C_6H_4—C(R^{T4})=C(R^{T5})(R^{T6})$ or $—C_6H_4—CH=CH—CH=C(R^{T7})(R^{T8})$. $R^{T4}$, $R^{T5}$, $R^{T6}$, $R^{T7}$, and $R^{T8}$ each independently represent a hydrogen atom, a substituted or unsubstituted alkyl group, or a substituted or unsubstituted aryl group. Examples of the substituent of the respective groups include a halogen atom, an alkyl group having 1 to 5 carbon atoms, and an alkoxy group having 1 to 5 carbon atoms. In addition, examples of the substituent of the respective groups include a substituted amino group which is substituted with an alkyl group having 1 to 3 carbon atoms.

(a-2)

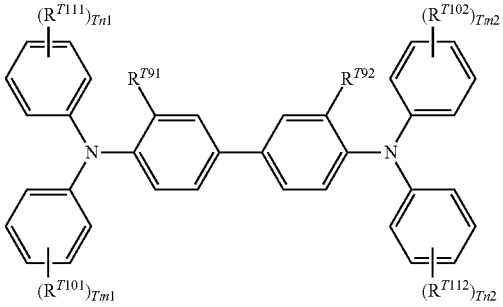

In the formula (a-2), $R^{T91}$ and $R^{T92}$ each independently represent a hydrogen atom, a halogen atom, an alkyl group having 1 to 5 carbon atoms, or an alkoxy group having 1 to 5 carbon atoms. $R^{T101}$, $R^{T102}$, $R^{T111}$ and $R^{T112}$ each independently represent a halogen atom, an alkyl group having 1 to 5 carbon atoms, an alkoxy group having 1 to 5 carbon atoms, an amino group which is substituted with an alkyl group having 1 to 2 carbon atoms, a substituted or unsubstituted aryl group, $—C(R^{T12})=C(R^{T13})(R^{T14})$, or $—CH=CH—CH=C(R^{T15})(R^{T16})$, and $R^{T12}$, $R^{T13}$, $R^{T14}$, $R^{T15}$ and $R^{T16}$ each independently represent a hydrogen atom, a substituted or unsubstituted alkyl group, or a substituted or unsubstituted aryl group. Tm1, Tm2, Tn1 and Tn2 each independently represent an integer of 0 to 2. Examples of the substituent of the respective groups include a halogen atom, an alkyl group having 1 to 5 carbon atoms, and an alkoxy group having 1 to 5 carbon atoms. In addition, examples of the substituent of the respective groups include a substituted amino group which is substituted with an alkyl group having 1 to 3 carbon atoms.

Among a triarylamine derivative expressed by the formula (a-1) and a benzidine derivative expressed by the formula (a-2), a triarylamine derivative having "$—C_6H_4—CH═CH—CH═C(R^{T7})(R^{T8})$", and a benzidine derivative having "$—CH═CH—CH═C(R^{T15})(R^{T16})$" are particularly preferable in terms of the charge mobility.

As the polymer charge transport material, a material having charge transporting properties such as poly-N-vinylcarbazole and polysilane is used. Particularly, a polyester polymer charge transport material, and the like is particularly preferable. The polymer charge transport material may be used alone, or may be used in combination with the binder resin.

Examples of the binder resin used for the charge transport layer include a polycarbonate resin, a polyester resin, a polyarylate resin, a methacrylic resin, an acrylic resin, a polyvinyl chloride resin, a polyvinylidene chloride resin, a polystyrene resin, a polyvinyl acetate resin, a styrene-butadiene copolymer, a vinylidene chloride-acrylonitrile copolymer, a vinyl chloride-vinyl acetate copolymer, a vinyl chloride-vinyl acetate-maleic anhydride copolymer, a silicone resin, a silicone alkyd resin, a phenol-formaldehyde resin, a styrene-alkyd resin, poly-N-vinylcarbazole, and polysilane. Among them, as the binder resin, the polycarbonate resin and the polyarylate resin are preferably used. These binder resins may be used alone or two or more types thereof may be used in combination.

The mixing ratio of the charge transport material to the binder resin is 10:1 to 1:5 by the weight ratio.

The charge transport layer may include other well-known additives.

The charge transport layer is not particularly limited, and a well-known forming method is used. For example, the method is performed in such a manner that a coated film coated with the coating liquid for forming a charge transport layer to which the above-described components are added as a solvent is coated, dried, and then heated if necessary.

Examples of the solvent for preparing the coating liquid forming a charge transport layer includes general organic solvents such as aromatic hydrocarbons such as benzene, toluene, xylene, and chlorobenzene; ketones such as acetone and 2-butanone; halogenated aliphatic hydrocarbons such as methylene chloride, chloroform, and ethylene chloride; and cyclic or linear ethers such as tetrahydrofuran and ethyl ether. These solvents may be used alone or two or more types thereof may be used in combination.

Examples of the method of coating the charge generation layer with the coating liquid for forming a charge transport layer include a general method such as a blade coating method, a wire-bar coating method, a spray coating method, a dipping coating method, a bead coating method, an air knife coating method, and a curtain coating method.

The thickness of the charge transport layer is, for example, preferably set to be in a range of from 5 μm to 50 μm, and is further preferably set to be in a range of from 10 μm to 30 μm.

Protective Layer

The protective layer is provided on the photosensitive layer if necessary. For example, the protective layer is provided so as to prevent the photosensitive layer during charge from being chemically changed, or to further enhance the technical strength of the photosensitive layer.

For this reason, the protective layer may employ a layer formed of a cured film (a cross-linked membrane). Examples of these layers include layers described in the following description 1) or 2).

1) A layer which is formed of a cured film of a composition including a reactive group-containing charge transport material having a reactive group and a charge transport skeleton in the same molecule (that is, a layer including a polymer or a crosslinked polymer of the reactive group-containing charge transport material)

2) A layer which is formed of a cured film of a composition including a non-reactive charge transport material and a reactive group-containing non-charge transport material having a reactive group without a charge transport skeleton (that is, a layer including a polymer or crosslinked polymer a non-reactive charge transport material and the reactive group-containing non-charge transport material)

Examples of the reactive group of the reactive group-containing charge transport material include well-known reactive groups such as a chain polymerization group, an epoxy group, —OH, —OR [here, R represents an alkyl group], $—NH_2$, —SH, —COOH, $—SiR^{Q1}{}_{3-Qn}(OR^{Q2})_{Qn}$ [here, $R^{Q1}$ represents a hydrogen atom, an alkyl group, or a substituted or non-substituted aryl group, $R^{Q2}$ represents a hydrogen atom, an alkyl group, and a trialkylsilyl group. Qn represents integer of 1 to 3].

The chain polymerization group is not particularly limited as long as it is a functional group capable of radical polymerization, and examples thereof include a functional group having a group containing at least carbon double bond. Specific examples thereof include a group containing at least one selected from a vinyl group, a vinyl ether group, a vinyl thioether group, a styryl group (vinyl phenyl group), an acryloyl group, a methacryloyl group, and derives thereof. Among them, in terms of excellent reactivity, a group containing at least one selected from a vinyl group, a styryl group (vinyl phenyl group), an acryloyl group, a methacryloyl group, and the derives thereof is preferably used as the chain polymerization group.

The charge transport skeleton of the reactive group-containing charge transport material is not particularly limited as long as it is a well-known structure in the electrophotographic photoreceptor. For example, a skeleton derived from a nitrogen-containing hole transport compound such as a triarylamine compound, a benzidine compound, and a hydrazone compound is used, and examples thereof include a structure is conjugated a nitrogen atom. Among them, the triarylamine skeleton is preferably used.

The reactive group-containing charge transport material having the reactive group and the charge transport skeleton, the non-reactive charge transport material, and the reactive group-containing charge transport material may be selected from well-known materials.

The protective layer may include other well-known additives.

The forming of the protective layer is not particularly limited, and a well-known forming method is used. For example, the method is performed in such a manner that a coated film coated with the coating liquid for forming a protective layer to which the above-described components are added as a solvent is coated, dried, and then heated if necessary.

Examples of the solvent for preparing the coating liquid for forming a protective layer includes an aromatic solvent such as toluene and xylene; a ketone solvent such as methyl ethyl ketone, methyl isobutyl ketone, and cyclohexanone; an ester solvent such as ethyl acetate and butyl acetate; an ether solvent such as tetrahydrofuran and dioxane; a cellosolve solvent such as ethylene glycol monomethyl ether; and an alcohol solvent such as isopropyl alcohol and butanol. These solvents may be used alone or two or more types thereof may be used in combination. The coating liquid for forming a protective layer may be a coating liquid of an inorganic solvent.

Examples of the method of coating the photosensitive layer (for example, a charge transport layer) with the coating liquid for forming a protective layer include a general method such as a dipping coating method, an extrusion coating method, a wire-bar coating method, a spray coating method, a blade coating method, a knife coating method, and a curtain coating method.

The thickness of the protective layer is preferably in a range of from 1 μm to 20 μm, and further preferably in a range of from 2 μm to 10 μm.

Single Layer-Type Photosensitive Layer

The single layer-type photosensitive layer (a charge generation or a charge transport layer) is a layer including, for example, a charge generation material and a charge transport material, and a binder resin and other well-known additives if necessary. Note that, these materials are the same as those in the description of the charge generation layer and the charge transport layer.

In the single layer-type photosensitive layer, the content of the charge generation material may be from 10% by weight to 85% by weight, and is further preferably from 20% by weight to 50% by weight with respect to the entire solid content. In addition, in the single layer-type photosensitive layer, the content of the charge transport material may be from 5% by weight to 50% by weight with respect to the entire solid content.

The method of forming the single layer-type photosensitive layer is the same as the method of forming the charge generation layer or the charge transport layer.

The thickness of the single layer-type photosensitive layer is, for example, from 5 μm to 50 μm, and is further preferably from 10 μm to 40 μm.

Image Forming Apparatus and Process Cartridge

The image forming apparatus according to the exemplary embodiment includes the photoreceptor, a charging unit that charges a surface of the photoreceptor, an electrostatic latent image forming unit that forms an electrostatic latent image on the charged surface of the photoreceptor, a developing unit that forms a toner image by developing the electrostatic latent image formed on the surface of the photoreceptor by using a developer containing a toner, and a transfer unit that transfers the toner image to a surface of a recording medium. In addition, as the photoreceptor, the photoreceptor according to the exemplary embodiment is employed.

As the image forming apparatus according to the exemplary embodiment, well-known image forming apparatuses such as an apparatus including fixing unit that fixes a toner image transferred on a surface of a recording medium; a direct-transfer type apparatus that directly transfers the toner image formed on the surface of the photoreceptor to the recording medium; an intermediate transfer type apparatus that primarily transfers the toner image formed on the surface of the photoreceptor to a surface of an intermediate transfer member, and secondarily transfers the toner image transferred to the intermediate transfer member to the surface of the recording medium; an apparatus including a cleaning unit that cleans the surface of the photoreceptor before being charged and after transferring the toner image; an apparatus includes an erasing unit that erases charges by irradiating the photoreceptor with erasing light before being charged and after transferring the toner image; and an apparatus including an photoreceptor heating member that increase the temperature of the photoreceptor so as to decrease a relative temperature are employed.

In a case where the intermediate transfer type apparatus is used, the transfer unit is configured to include an intermediate transfer member that transfers the toner image to the surface, a primary transfer unit that primarily transfers the toner image formed on the surface of the photoreceptor toner image to the surface of the intermediate transfer member, and a secondary transfer unit the toner image formed on the surface of the intermediate transfer member is secondarily transferred to the surface of the recording medium.

The image forming apparatus according to the exemplary embodiment may be any type of a dry developing type image forming apparatus and a wet developing type (developing type using a liquid developer) image forming apparatus.

In the image forming apparatus according to the exemplary embodiment, for example, a unit including the photoreceptor may be a cartridge structure (process cartridge) detachable from the image forming apparatus. As a process cartridge, for example, a process cartridge including the photoreceptor according to the exemplary embodiment is preferably used. In addition, in addition to the photoreceptor, at least one selected from the group consisting of a charging unit, an electrostatic latent image forming unit, a developing unit, and a transfer unit may be included in the process cartridge.

Hereinafter, an example of the image forming apparatus of the exemplary embodiment will be described; however, the invention is not limited thereto. Note that, in the drawing, major portions will be described, and others will not be described.

Figure 5:
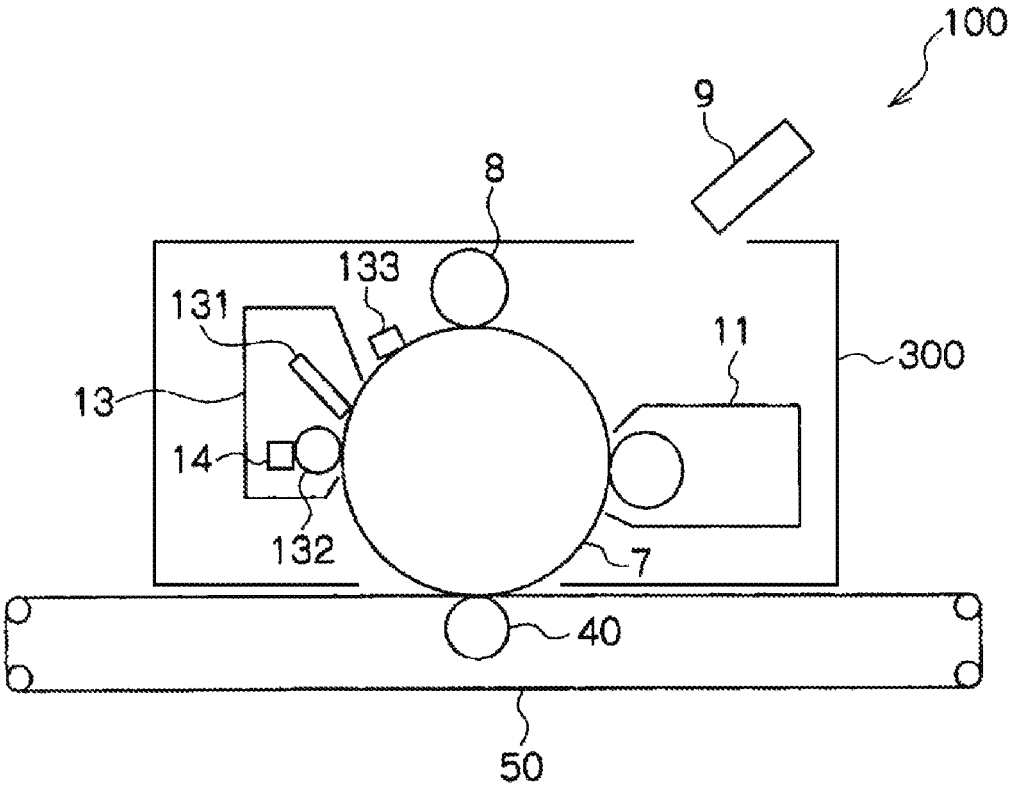
FIG. 5 is a configuration diagram schematically illustrating an example of an image forming apparatus according to the exemplary embodiment.

FIG. 5 is a schematic configuration diagram illustrating an example of the image forming apparatus according to the exemplary embodiment.

As illustrated in FIG. 5, an image forming apparatus 100 according to the exemplary embodiment includes a process cartridge 300 which is provided with an photoreceptor 7, an exposure device 9 (an example of the electrostatic latent image forming unit), a transfer device 40 (an example of the primary transfer device), and an intermediate transfer member 50. In the image forming apparatus 100, the exposure device 9 is disposed at a position so as to expose the photoreceptor 7 from an opening of the process cartridge 300, the transfer device 40 is disposed at a position facing the photoreceptor 7 via the intermediate transfer member 50, and the intermediate transfer member 50 is disposed such that a portion thereof contacts the photoreceptor 7. Although not shown, the image forming apparatus 100 also includes a secondary transfer device that transfers the toner image which is transferred to the intermediate transfer member 50 to a recording medium (for example, recording sheet). The intermediate transfer member 50, the transfer device 40 (the primary transfer device), and the secondary transfer device (not shown) correspond to examples of the transfer unit.

The process cartridge 300 in FIG. 5 integrally supports an photoreceptor 7, a discharging device 8 (an example of the charging unit), a developing device 11 (an example of the developing unit), and a cleaning device 13 (an example of the cleaning unit) in a housing. The cleaning device 13 includes a cleaning blade (an example of the cleaning member) 131, the cleaning blade 131 is disposed so as to contact the surface of the photoreceptor 7. Note that, the cleaning member is not limited to the cleaning blade 131, and may be a conductive or an insulating fibrous member, which may be used alone or used in combination with the cleaning blade 131.

FIG. 5 illustrates an example of the image forming apparatus including a fibrous member 132 (roller shape) for supplying a lubricant 14 to the surface of the photoreceptor 7, and a fibrous member 133 (flat brush) for assisting the cleaning step, and the above members are disposed as necessary.

Hereinafter, the respective configurations of the image forming apparatus according to the exemplary embodiment will be described.

Discharging Device

Examples of the discharging device 8 include a contact-type charging device using a conductive or a semi conductive charging roller, a charging brush, a charging film, a charging rubber blade, and a charging tube. In addition, well-known discharging devices such as a non-contact type roller charging device, a scorotron charging device using corona discharge and a corotron charging device are also used.

Exposure Device

Examples of the exposure device 9 include an optical device that exposes the light such as a semiconductor laser beam, LED light, and liquid crystal shutter light to a determined image on the surface of the photoreceptor 7. The wavelength of the light source is set to be within a spectral sensitivity region of the electrophotographic photoreceptor. The wavelength of the semiconductor laser beam is mainly near-infrared having an oscillation wavelength in the vicinity of 780 nm. However, the wavelength is not limited, the oscillation wavelength laser having a level of 600 nm or laser having the oscillation wavelength in a range of from 400 nm to 450 nm as a blue laser may be also used. In addition, a surface emission-type laser light source capable of outputting a multi-beam is also effective to form a color image.

Developing Device

Examples of the developing device 11 include a general developing device that contacts or non-contacts a developer so as to develop an image. The developing device 11 is not particularly limited as long as it has the above-described function, and is selected on the purpose. For example, a well-known developing device having a function of attaching a one component developer or a two-component developer to the photoreceptor 7 by using a brush, a roller, or the like may be exemplified. Among them, a developing roller holding the developer on the surface is preferably used.

The developer used for the developing device 11 may be a one component developer containing only a toner or may be a two-component developer containing a toner and a carrier. In addition, the developer may be magnetic or non-magnetic. As the developer, well-known developers are used.

Cleaning Device

As the cleaning device 13, a cleaning blade-type device including a cleaning blade 131 is used. In addition to the cleaning blade-type device, a fur brush cleaning device and a simultaneous developing and cleaning device may be also employed.

Transfer Device

Examples of the transfer device 40 include well-known transfer charging device such as a contact type transfer charger using a belt, a roller, a film, a rubber blade, and the like, a scorotron transfer charger using corona discharge, and a corotron transfer charger are also used.

Intermediate Transfer Member

Examples of the intermediate transfer member 50 include a belt-type member (an intermediate transfer belt) containing polyimide, polyamideimide, polycarbonate, polyarylate, polyester, rubber, and the like to which semi conductivity is imparted. The shape of the intermediate transfer member may be a drum in addition to the belt shape.

Figure 6:
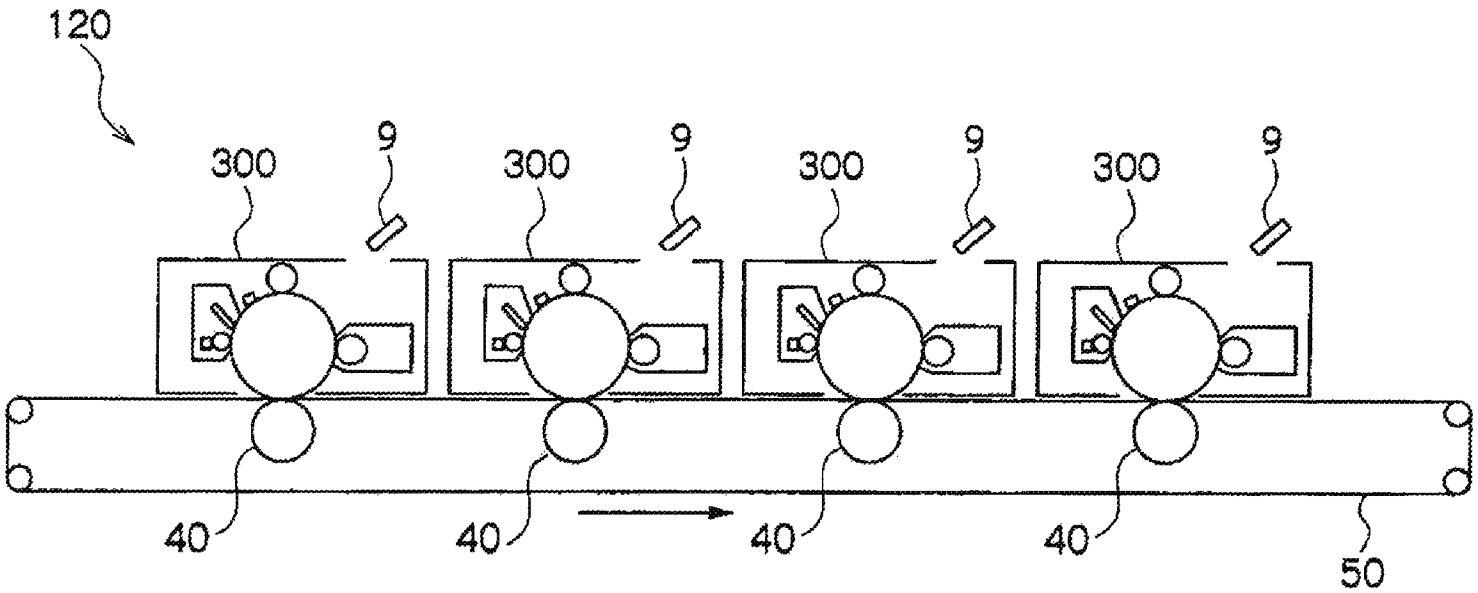
FIG. 6 is a configuration diagram schematically illustrating an example of the image forming apparatus according to the exemplary embodiment.

FIG. 6 is a schematic configuration diagram illustrating another example of an image forming apparatus according to the exemplary embodiment.

The image forming apparatus 120 illustrated in FIG. 6 is a tandem type multi-color image forming apparatus including four process cartridges 300. In the image forming apparatus 120, the four process cartridges 300 are arranged in parallel on the intermediate transfer member 50, and one photoreceptor is used for one color. The image forming apparatus 120 has a configuration which is the same as that of the image forming apparatus 100 except that it is a tandem type image forming apparatus.

EXAMPLES

Hereinafter, the exemplary embodiment is described in detail with reference to examples; however, the exemplary embodiment is not limited to the following examples.

Preparing of Conductive Support

A metal ingot having a diameter of 34 mm and a thickness of 14 mm is prepared by punching a metal plate having a thickness of 14 mm (aluminum purity of 99.7% or more, JIS designation: A1070 alloy).

A cylindrical tube having an outer diameter of 34 mm is molded by applying magnesium stearate (N.P.-1500S manufactured by TANNAN KAGAKU KOGYO Co., Ltd.) as a lubricant on the surface of the metal ingot through impact pressing. Then, ironing is performed once so as to cut off both ends, and then an end surface treatment is performed so as to prepare a cylindrical tube having an outer diameter of 30 mm, a length of 251 mm, and a thickness of 0.7 mm, which is set as a conductive support 1.

Except for the amount of lubricant to be applied, conductive supports 2 to 8 are prepared in the same way as described above. In addition, conductive supports 9 and 10 are prepared in the same way as described above except that the lubricant is changed to a mixture of trimethylolpropane trioleate and polybutene (the mixing ratio=30 parts by weight to 70 parts by weight).

Distribution data of the recessed portion is obtained by inspecting the entire outer peripheral surface of the conductive support by using an automatic surface inspection machine. An opening diameter and a depth of the recessed portion having an opening diameter which is 100 μm or more are measured by using a laser microscope while specifying the position of the recessed portion based on the recessed portion distribution data. Among the measured recessed portions, a dimension of the recessed portion having the maximum opening diameter and a dimension of the recessed portion having the maximum aspect ratio are indicated in Table 1.

TABLE 1

| Conductive support | Recessed portion having maximum opening diameter: Opening diameter μm | Depth μm | Aspect ratio — | Recessed portion having maximum aspect ratio: Opening diameter μm | Depth μm | Aspect ratio — |
|---|---|---|---|---|---|---|
| Support 1 | 385 | 19 | 0.049 | 101 | 10 | 0.099 |
| Support 2 | 398 | 20 | 0.050 | 102 | 10 | 0.098 |
| Support 3 | 372 | 19 | 0.051 | 110 | 10 | 0.091 |
| Support 4 | 392 | 20 | 0.051 | 104 | 9 | 0.087 |
| Support 5 | 381 | 18 | 0.047 | 100 | 10 | 0.100 |
| Support 6 | 388 | 20 | 0.052 | 100 | 12 | 0.120 |
| Support 7 | 384 | 20 | 0.052 | 101 | 16 | 0.158 |
| Support 8 | 392 | 20 | 0.051 | 100 | 18 | 0.180 |
| Support 9 | 420 | 25 | 0.060 | 102 | 9 | 0.088 |
| Support 10 | 450 | 25 | 0.056 | 101 | 10 | 0.099 |

Preparing of Photoreceptor

Photoreceptors 1 to 12 are obtained by forming layers in accordance with the following steps of the conductive supports 1 to 10.

Forming Undercoating Layer 100 parts by weight of zinc oxide (average particle size of 70 nm, specific surface area of 15 $m^2/g$, manufactured by TAYACA CORPORATION) and 500 parts by weight of toluene are stirred and mixed with each other, 1.3 parts by weight of silane coupling agent (product name: KBM603, manufactured by Shin-Etsu Chemical Co., Ltd., N-2-(aminoethyl)-3-aminopropyl trimethoxy silane) is added thereto, and the mixture is stirred for two hours. After that, zinc oxide is obtained by distilling off the toluene under reduced pressure, sintering the distilled toluene at 120° C. for three hours, and then performing a surface treatment by using a silane coupling agent.

110 parts by weight of zinc oxide on which the surface treatment is performed and 500 parts by weight tetrahydrofuran are stirred and mixed with each other, a solution in which 0.6 parts by weight of alizarin is dissolved into 50 parts by weight tetrahydrofuran is added to the mixture and stirred at 50° C. for five hours. After that, a solid was filtered off under reduced pressure filtration, and dried under reduced pressure at 60° C. so as to obtain alizarin-added zinc oxide.

60 parts by weight of the alizarin-added zinc oxide, 13.5 parts by weight of curing agent (blocked isocyanate SUMIDUR 3175, manufactured by Sumitomo-Bayer Urethane Co., Ltd.), 15 parts by weight of butyral resin (S-LEC BM-1, manufactured by Sekisui Chemical Co., Ltd.) and 68 parts by weight of methyl ethyl ketone are mixed to prepare a mixed solution. Then, 100 parts by weight of the mixed solution and 5 parts by weight of methyl ethyl ketone are mixed with each other, and dispersion is performed for 2 hours using a sand mill with 1 mmϕ glass beads. As a result, a dispersion is obtained. To this dispersion, as a catalyst, 0.005 parts by weight of dioctyl tin dilaurate and 4 parts by weight of silicone resin particles (TOSPEARL 145, manufactured by Momentive Performance Materials Inc.) are added. As a result, a coating solution for forming an undercoat layer is obtained. The coating solution for forming an undercoat layer is coated on the outer peripheral surface of the conductive support by using a dipping coating method, followed by drying and curing at 170° C. for 40 minutes. As a result, an undercoat layer is formed. The thickness of the undercoating layer (average thickness (μm)) is as indicated in Table 2.

Forming Charge Generation Layer 15 parts by weight of hydroxygallium phthalocyanine, as the charge generation material (having diffraction peaks at Bragg angles (2θ±0.20) of at least 7.5°, 9.9°, 12.5°, 16.3°, 18.6°, 25.1°, and 28.3° in an X-ray diffraction spectrum using CuKα characteristic X-ray), 10 parts by weight of vinyl chloride-vinyl acetate copolymer resin (VMCH, manufactured by Nippon Unicar Co., Ltd.) as the binder resin, and 200 parts by weight of n-butyl acetate are mixed to obtain a mixture. The mixture is dispersed using a sand mill with glass beads having a diameter of 1 mmϕ for 4 hours. 175 parts by weight of n-butyl acetate and 180 parts by weight of methyl ethyl ketone are added to the obtained dispersion, followed by stirring. As a result, a coating liquid for forming a charge generation layer is obtained. This coating liquid for forming a charge generation layer is dip-coated on the undercoat layer, followed by drying at room temperature (25° C.). As a result, a charge generation layer having a thickness of 0.18 μm is formed.

Forming Charge Transport Layer 8 parts by weight butadiene charge transport material expressed by the following formula (CT1A) and 32 parts by weight of benzidine charge transport material expressed by the following formula (CT2A) as the charge transport material, 58 parts by weight bisphenol Z-type polycarbonate resin (a homopolymer of bisphenol Z, viscosity-average molecular weight of 40,000) as a binder resin, and 2 parts by weight of hindered phenol antioxidant expressed by the following formula (HP-1) as antioxidant are dissolved in 340 parts by weight of tetrahydrofuran. As a result, the coating liquid for forming a charge transport layer is obtained. This coating liquid for forming a charge transport layer is dip-coated on the charge generation layer, followed by drying at 145° C. for 30 minutes. As a result, a charge transport layer having a thickness of 24 μm is formed.

(CT1A)

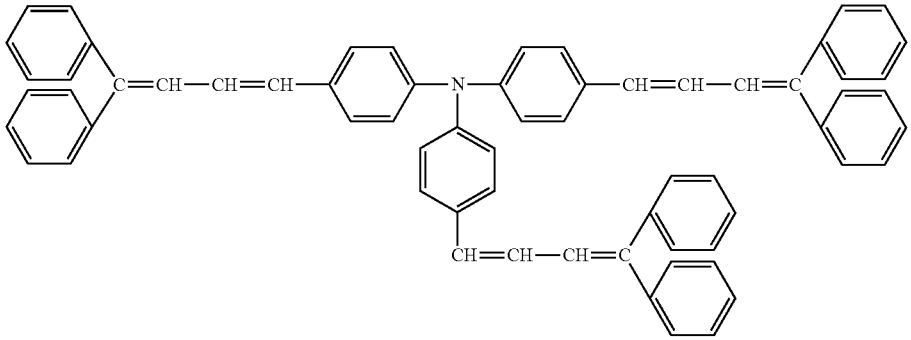

(CT2A)

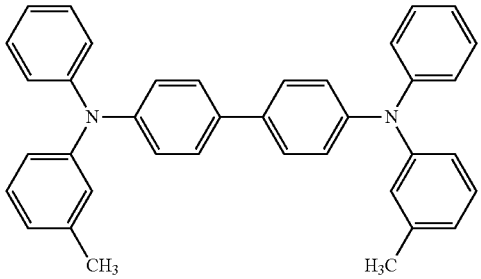

(HP-1)

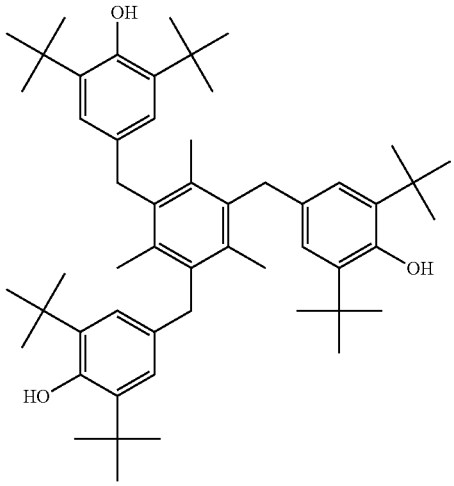

The photoreceptors 1 to 12 which include any one of the conductive supports 1 to 10 are obtained through the above-described steps.

Inspection of Recessed Portion of Outermost Layer

An opening diameter and a depth of a second recessed portion are measured by using a laser microscope while specifying a position of a recessed portion (the second recessed portion) on which a recessed portion (a first recessed portion) which is present on the outer peripheral surface of the conductive support is reflected, based on the recessed portion distribution data of conductive support outer peripheral surface. Among the measured recessed portions, a dimension of the recessed portion having the maximum opening diameter and a dimension of the recessed portion having the maximum aspect ratio are indicated in Table 2.

Evaluation of Photoreceptor

Each of the photoreceptors 1 to 12 is mounted on an image forming apparatus (DocuPrint P350d manufactured by Fuji Xerox Co., Ltd.) so as to perform the following image quality evaluation. The results are shown in Table 2.

White Spot

Under the environment of temperature of 22° C. and relative humidity of 55%, ten A4-sized sheets having a solid image (100% image density) are printed, and the presence of the white spot is visually observed. The evaluation criteria are as follows.

A: white spot is not recognized in all of ten sheets of printed solid image

B: white spot is recognized in one or two sheets of ten sheets of printed solid image C: white spot is recognized in three to five sheets of ten sheets of printed solid image D: white spot is recognized in six to nine sheets of ten sheets of printed solid image E: white spot is recognized in all of ten sheets of printed solid image Regarding the photoreceptors 2 and 6 which are rated as B, the photoreceptors 1 and 9 which are rated as C, the photoreceptors 7, 8 and 10 which are rated as D, and the photoreceptors 11 and 12 which are rated as E, the examination for whether or not the generated white spots are caused by any one of the second recessed portions which are distributed on the outer peripheral surface of the photosensitive layer is performed. With respect to the photoreceptors 1, 2, 6, 7, 8, 9, and 10, the second recessed portion having the maximum aspect ratio frequently generates the white spot. With respect to the photoreceptors 11 and 12, the second recessed portion having the maximum opening diameter frequently generates the white spot.

Ghost

Figure 7A:
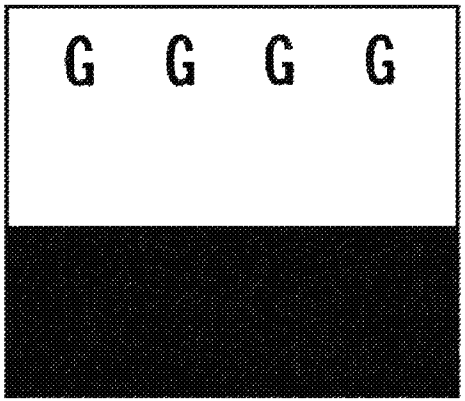
FIG. 7A to FIG. 7C are an explanatory diagrams illustrating criteria of ghost evaluation.
Figure 7B:
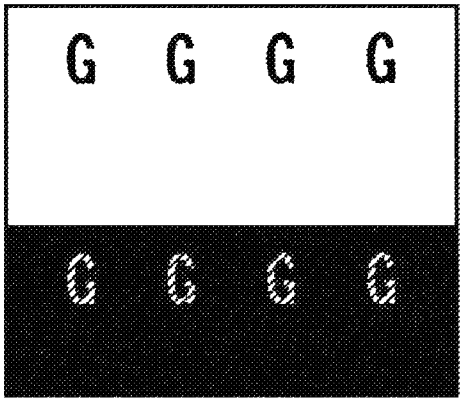
Figure 7C:
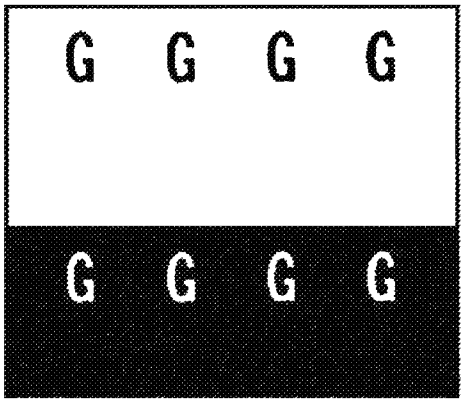

Under the environment of temperature of 22° C. and relative humidity of 55%, a pattern having a letter G and a black area are printed on A4-sized sheets as illustrated in FIG. 7A to FIG. 7C, and a state where the letter G appears in the black area is visually observed. The evaluation criteria are as follows.

A: as illustrated in FIG. 7A, letter G is not recognized

B: as illustrated in FIG. 7B, letter G is slightly recognized

C: as illustrated in FIG. 7C, letter G is clearly recognized

TABLE 2

| | | | | Recessed portion of conductive support (first recessed portion) | | | | | |
|---|---|---|---|---|---|---|---|---|---|
| | | | Undercoating layer | Recessed portion having maximum opening diameter | | | Recessed portion having maximum aspect ratio | | |
| | Photoreceptor | Conductive support | Average thickness μm | Opening diameter μm | Depth μm | Aspect ratio — | Opening diameter μm | Depth μm | Aspect ratio — |
| Example 1 | Photoreceptor 1 | Support 1 | 20 | 385 | 19 | 0.049 | 101 | 10 | 0.099 |
| Example 2 | Photoreceptor 2 | Support 2 | 25 | 398 | 20 | 0.050 | 102 | 10 | 0.098 |
| Example 3 | Photoreceptor 3 | Support 3 | 30 | 372 | 19 | 0.051 | 110 | 10 | 0.091 |
| Example 4 | Photoreceptor 4 | Support 4 | 35 | 392 | 20 | 0.051 | 104 | 9 | 0.087 |
| Example 5 | Photoreceptor 5 | Support 5 | 40 | 381 | 18 | 0.047 | 100 | 10 | 0.100 |
| Example 6 | Photoreceptor 6 | Support 6 | 35 | 388 | 20 | 0.052 | 100 | 12 | 0.120 |
| Comparative Example 1 | Photoreceptor 7 | Support 6 | 20 | 388 | 20 | 0.052 | 100 | 12 | 0.120 |
| Comparative Example 2 | Photoreceptor 8 | Support 7 | 25 | 384 | 20 | 0.052 | 101 | 16 | 0.158 |
| Comparative Example 3 | Photoreceptor 9 | Support 7 | 45 | 384 | 20 | 0.052 | 101 | 16 | 0.158 |
| Comparative Example 4 | Photoreceptor 10 | Support 8 | 35 | 392 | 20 | 0.051 | 100 | 18 | 0.180 |
| Comparative Example 5 | Photoreceptor 11 | Support 9 | 25 | 420 | 25 | 0.060 | 102 | 9 | 0.088 |
| Comparative Example 6 | Photoreceptor 12 | Support 10 | 30 | 450 | 25 | 0.056 | 101 | 10 | 0.099 |

| | Recessed portion of outermost layer (second recessed portion) | | | | | | | |
|---|---|---|---|---|---|---|---|---|
| | Recessed portion having maximum opening diameter | | | Recessed portion having maximum aspect ratio | | | Image quality | |
| | Opening diameter μm | Depth μm | Aspect ratio — | Opening diameter μm | Depth μm | Aspect ratio — | White spot | Ghost |
| Example 1 | 504 | 6.1 | 0.012 | 130 | 3.4 | 0.026 | C | A |
| Example 2 | 525 | 5.6 | 0.011 | 132 | 2.9 | 0.022 | B | A |
| Example 3 | 480 | 4.6 | 0.010 | 141 | 2.4 | 0.017 | A | A |
| Example 4 | 510 | 4.5 | 0.009 | 137 | 2.0 | 0.014 | A | A |
| Example 5 | 491 | 3.5 | 0.007 | 130 | 2.0 | 0.015 | A | B |
| Example 6 | 499 | 4.4 | 0.009 | 130 | 2.7 | 0.021 | B | A |
| Comparative Example 1 | 452 | 6.0 | 0.013 | 120 | 4.0 | 0.033 | D | A |
| Comparative Example 2 | 499 | 5.7 | 0.011 | 131 | 4.6 | 0.035 | D | A |
| Comparative Example 3 | 512 | 5.0 | 0.010 | 135 | 4.0 | 0.030 | C | C |
| Comparative Example 4 | 509 | 4.4 | 0.009 | 130 | 4.0 | 0.031 | D | A |
| Comparative Example 5 | 546 | 7.1 | 0.013 | 133 | 2.6 | 0.019 | E | A |
| Comparative Example 6 | 585 | 6.3 | 0.011 | 131 | 2.5 | 0.019 | E | A |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrophotographic photoreceptor comprising:

a conductive support in which (i) a recessed portion having an opening diameter of greater than 400 μm and (ii) a recessed portion having an opening diameter of from 100 μm to 400 μm and a ratio of a depth to an opening diameter of greater than 0.12 are not present on an outer peripheral surface of the conductive support, and a first recessed portion having an opening diameter of from 100 μm to 400 μm and a ratio of a depth to an opening diameter of 0.12 or less is present on the outer peripheral surface of the conductive support;

an undercoating layer that is provided on the conductive support; and a photosensitive layer that is provided on the undercoating layer, wherein a second recessed portion on which the first recessed portion is reflected is present on an outer peripheral surface of an outermost layer of the electrophotographic photoreceptor, a ratio of a depth to an opening diameter of the second recessed portion is not greater than 0.030.

2. The electrophotographic photoreceptor according to claim 1, wherein the ratio of the depth to the opening diameter of the first recessed portion is 0.11 or less.

3. The electrophotographic photoreceptor according to claim 1, wherein the ratio of the depth to the opening diameter of the first recessed portion is 0.10 or less.

4. The electrophotographic photoreceptor according to claim 1, wherein the ratio of the depth to the opening diameter of the second recessed portion is 0.025 or less.

5. The electrophotographic photoreceptor according to claim 1, wherein the ratio of the depth to the opening diameter of the second recessed portion is 0.020 or less.

6. The electrophotographic photoreceptor according to claim 1, wherein the conductive support is an impact press article.

7. The electrophotographic photoreceptor according to claim 1, wherein the conductive support is an impact press article which is subjected to ironing.

8. The electrophotographic photoreceptor according to claim 1, wherein an average thickness of the undercoating layer is from 20 μm to 40 μm.

9. The electrophotographic photoreceptor according to claim 1, wherein an average thickness of the undercoating layer is from 25 μm to 35 μm.

10. The electrophotographic photoreceptor according to claim 1, wherein the conductive support is formed of metal containing aluminum.

11. A process cartridge that comprises the electrophotographic photoreceptor according to claim 1 and is detachable from an image forming apparatus.

12. An image forming apparatus comprising:

the electrophotographic photoreceptor according to claim 1;

a charging unit that charges a surface of the electrophotographic photoreceptor;

an electrostatic latent image forming unit that forms an electrostatic latent image on a charged surface of the electrophotographic photoreceptor;

a developing unit that forms a toner image by developing the electrostatic latent image formed on the surface of the electrophotographic photoreceptor with a developer containing toner; and a transfer unit that transfers the toner image to a surface of a recording medium.

* * * * *